US005556044A

United States Patent [19]

Hobson

[11] Patent Number: 5,556,044

[45] Date of Patent: Sep. 17, 1996

[54] PULVERISING DISC

[75] Inventor: Barry R. Hobson, Bassendean, Australia

[73] Assignee: East Bank Holdings Pty Ltd., Western Australia, Australia

[21] Appl. No.: 385,598

[22] Filed: Feb. 8, 1995

[30] Foreign Application Priority Data

Feb. 8, 1994 [AU] Australia ..... PM3742
Jul. 4, 1994 [AU] Australia ..... PM6620

[51] Int. Cl.[6] ..... B02C 15/00

[52] U.S. Cl. ..... 241/296; 241/175

[58] Field of Search ..... 241/169.1, 169.2, 241/296, DIG. 27, 175

[56] References Cited

U.S. PATENT DOCUMENTS

| | | | |
|---|---|---|---|
| 3,416,740 | 12/1968 | Hodgson et al. . | |
| 4,121,775 | 10/1978 | Rosenberg et al. | 241/30 |
| 4,212,430 | 7/1980 | Dale et al. | 241/89.4 |
| 4,602,746 | 7/1986 | Stockmann et al. | 241/215 |
| 4,607,801 | 8/1986 | Harvey | 241/199.1 |
| 5,390,859 | 2/1995 | Rajasekaran | 241/2 |

FOREIGN PATENT DOCUMENTS

| | | | |
|---|---|---|---|
| 79021/75 | 6/1979 | Australia . | |
| 44279/79 | 9/1982 | Australia . | |
| 15506/88 | 6/1989 | Australia . | |
| 1203100 | 10/1965 | Germany | 241/DIG. 27 X |
| 5345137 | 12/1993 | Japan | 241/296 |

*Primary Examiner*—John Husar
*Attorney, Agent, or Firm*—Larson and Taylor

[57] ABSTRACT

A pulverizing disc 10 is disclosed which comprises a main body 11 of a generally cylindrical shape with a circumferential wall 12, lower surface 13 and upper surface 14. The main body 11 is integrally formed with a second body 14 which is also of generally cylindrical shape and which is mounted centrically upon the upper surface 14. The second body 15 extends from one side of the main body 11 to a position beyond a central axis 16 of the main body 11. An aperture 17 is formed through the disc 10 along the central axis 16. An upper surface 19 of the second body 15 is bevelled downwardly in the radial direction from axis 16 to form a central high region 18 around the perimeter aperture 17. The bottom surface of the first body 11 can be formed with a flute 23 which extends radially from aperture 17 to circumferential wall 12 of the first body 11. A valve 24 disposed in aperture 17 can be used to control the direction of fluid flow so that fluid can flow only from above the disc 10 through aperture 17 to below the disc 10. This allows pressure equalization across the disc 10 and assists in preventing the stalling of the disc 10 when in use.

13 Claims, 3 Drawing Sheets

PULVERISING DISC

BACKGROUND OF THE INVENTION

1. Field of the Invention

This invention relates to a pulverising disc and in particular, but not exclusively, to a pulverising disc for use in pulverising mill for grinding minerals.

2. Description of the Prior Art

Pulverising mills have long been used to pulverise and grind mineral samples into a fine powder. The powder may then be used for mineral assaying or other purposes. Typically a pulverising mill comprises a metal bowl having a generally cylindrical internal side wall and a planar base. Sometimes an angled or shaped surface is also provided between the bottom of the side wall and the base of the bowl. The bowl is mounted on a vibrating table which produces vibrating motion in an essentially horizontal plane.

A mineral sample to be pulverised is placed in the bowl together with a pulverising disc and a lid clamped on the bowl. Due to the action of the vibrating table the pulverising disc is caused to move around the side wall of the bowl and as a result crush and grind the mineral sample. Typically pulverising discs are in the form of squat metal cylinders of substantially uniform thickness, although peripheral steps or bevels are often present. In some instances, a portion of the rim of the disc is machined to have a shape which corresponds to the portion of the bowl where the inner side wall meets the base. This is thought to improve the efficiency of the pulverising disc and pulverising mill. However, in practice, after a short period of use, the rim of a pulverising disc will wear to a shape corresponding the part of the bowl which it contacts. Pulverising discs of this type are disclosed in the specifications of Australian Patent No's 585751 and 570814.

A deficiency with the above prior art pulverising disc is that it adopts a simple path of motion within the bowl and has limited force generation capability which increases the likelihood of the pulverising disc stalling as well as increasing the time taken to grind a sample to a given mesh size and, indeed limits the mesh size that can be achieved.

The applicant has also found that with the movement of the pulverising disc within the bowl, a low pressure region is created between the undersurface of the disc and the bottom surface of the bowl. This creation of a low pressure region is further compounded as the material is reduced in size and can result in that low pressure region becoming sealed from the remainder of the space within the bowl which can also contribute to the pulverising disc stalling.

The present invention was developed with a view to providing a pulverising disc which can quickly and efficiently pulverise a mineral sample or other material with reduced likelihood of stalling.

SUMMARY OF THE INVENTION

According to one aspect of the present invention there is provided a pulverising disc comprising:

a main body of generally cylindrical shape; and, a second body supported on an upper surface of said main body in a manner so that said first body and said second body are fixed relative to each other when said pulverizing disc moves, said second body being disposed eccentrically of said main body.

According to a preferred feature of the invention, said pulverising disc is provided with an aperture extending between a top surface and a bottom surface of the pulverising disc whereby in use air can flow from above said pulverising disc through said aperture to beneath said pulverising disc. Advantageously a one way valve is provided in said aperture to permit unidirectional flow of air from above the top surface to below the bottom surface. Preferably, the aperture is formed about a central axis of the disc. Furthermore, the aperture may be of substantially constant cross-section throughout its length or alternatively may be divergent from one of the top and bottom surfaces to the other.

Preferably the bottom surface of the disc is formed with a radial recess extending across at least a portion thereof to an edge of the disc. The presence of the recess can serve to provide a means for venting any low pressure regions created between the lower end surface of the disc and the bottom of a pulveriser.

Preferably said second body is formed integrally with main body. Alternately the second body is moveably supported on the main body so that the degree of eccentricity can be varied in accordance with the nature of the material to be ground by the disc and the degree of pulverisation required.

Preferably the second body extends across the upper surface of the main body from a position at one side of the main body to a position overlying a central axis of the disc. A further preferred feature of this embodiment provides that the aperture extends through the second body.

Preferably an upper surface of the second body is bevelled in the radial direction from the central axis of the disc to produce a central high region on the second body about the periphery of the aperture which is adapted to abut a lid of a pulveriser bowl of a pulverising mill during a primary grinding phase. It has been found that this feature enables the disc when placed into a bowl to pivot about the aperture in the primary phase of grinding. This introduces a further degree of freedom into the movement of the disc as it is caused to move through the bowl when the disc is held against the lid by the contents of the bowl. This additional movement enhances the pulverising and mixing action which can be produced by the disc in the early stages of the operation of the pulveriser.

BRIEF DESCRIPTION OF THE DRAWINGS

Embodiments of invention will be now described, by way of example only, with reference to the accompanying drawings which.

DESCRIPTION OF THE PREFERRED EMBODIMENTS

Figure 1:
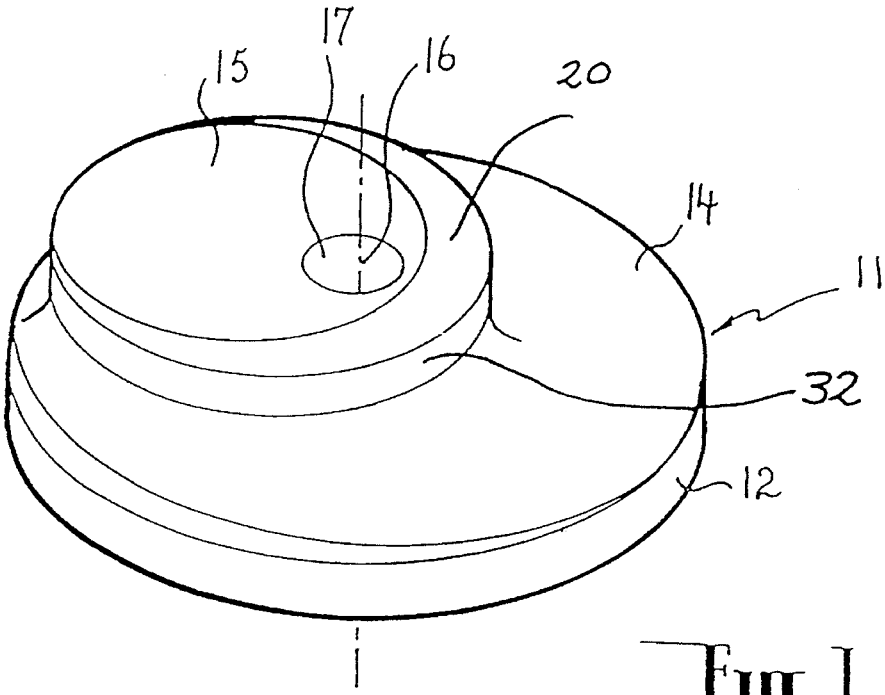
FIG. 1 is general isometric view of a pulverising disc according to each of the embodiments.

The pulverising disc 10 comprises a main body 11 of a generally cylindrical shape with a circumferential wall 12, lower surface 13 and an upper surface 14. The main body 11 is integrally formed with a second body 15 which is also of a generally cylindrical shape and which is mounted eccentrically upon the upper surface 14. The second body 15 forms a boss-like projection on the main body 11.

The disc 10 has formed through it an aperture 17 which extends from upper surface 19 of the second body 15 to the lower surface 13. The aperture 17 is substantially concentric with central axis 16 of the disc 10.

Upper surface 19 is bevelled downwardly in the radial direction from axis 16 to form a central high region 18 around the perimeter of the aperture 17. In addition, the region of the second body between the upper surface 19 and side wall 32 of the second body is formed with a chamfer 20.

Upper surface 14 of main body 11 is downwardly bevelled radially from central axis 16 so as to be substantially conical in shape. A second chamfer 22 is formed between the upper surface 14 of the main body and the circumferential wall 12 of the main body. Because upper surface 14 of the main body is formed about the centre axis (not shown) of second body 15 the width of the chamfer 22 varies around the circumference of the second body whereby the chamfer has its greatest width in the region most adjacent the second body 15 and has its least width at the position most remote from the second body 15.

The lower surface 13 of main body 11 corresponds to bottom surface 33 of the disc 10. The combination of upper surface 19, first chamfer 20, and side wall 32 of the second body 15 together with upper surface 14 of the main body 11 corresponds to top surface 35 of the disc 10, (refer FIG. 2*a*).

Figure 2B:
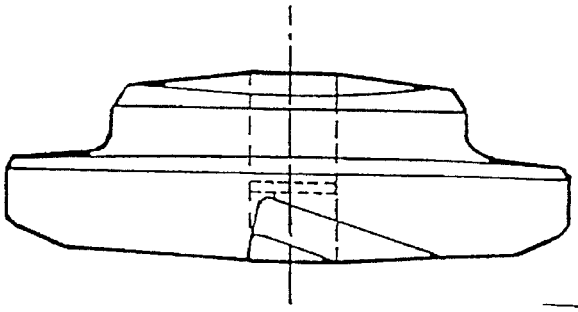
FIG. 2*a* and 2*b* are front and side elevation of a pulverising disc according to a first embodiment of the invention.
Figure 2A:
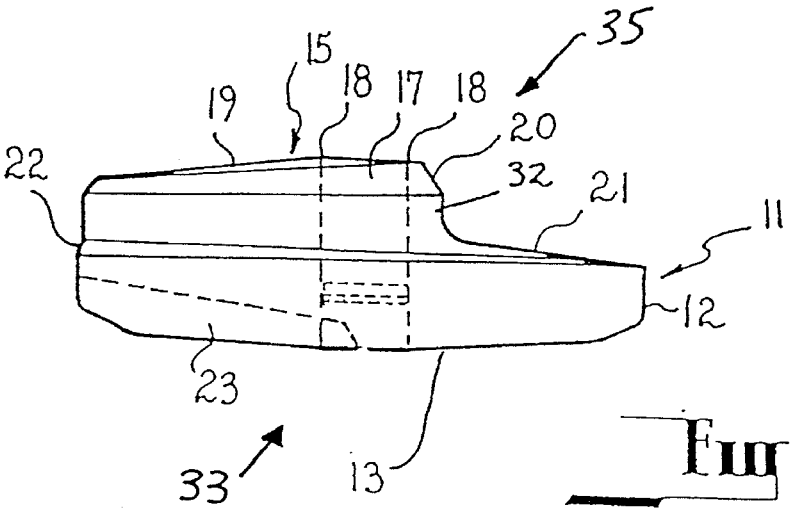

In relation to the first embodiment shown at FIGS. 2*a* and 2*b*, the bottom surface 33 of the pulverising disc is formed with a radial recess in the form of flute 23 which extends from the aperture 17 across the bottom surface 33 to one edge thereof. Although the recess need not necessary be in fluid communication with aperture 17 and may extend along any portion bottom surface 33 to an edge thereof.

Figure 7:
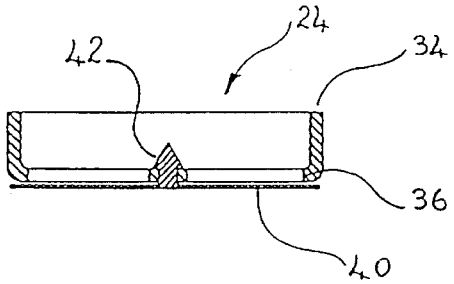
FIG. 7 is a cross-sectional view of a valve which can be incorporated in the pulverising disc; and, FIG. 8 is a top view of the valve shown in FIG. 7.
Figure 8:
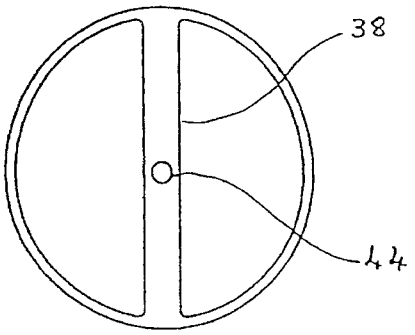

In each of the embodiments, the central aperture 17 may be demountably fitted with a valve 24 (refer FIGS. 3, 7 and 8) which controls the flow of fluid through the aperture 17, whereby fluid flow is only permitted from above the top surface 35 to below the bottom surface 33 of the disc and no fluid flow is permitted in the reverse direction. The valve 24 can be taken out of aperture 17 from time to time for cleaning or replacement.

Valve 24 comprises a cylindrical ring 34 having a lower end 36 curved radially inwardly. A bridge 38 extends from side to side along a diameter of the ring 34. Rubber flap 40 lies beneath the ring 34 and has its peripheral edge abutting the lower end 36. An arrow like projection 42 extends from the centre of rubber flap 40 and passes through a central hole 44 formed in the bridge 38 so as to attach the flap 40 to the ring 34. When the valve 24 is placed in aperture 17 it is orientated so that the arrow like projection 42 points towards the top surface 35. Accordingly, when a pressure differential exists between the top and bottom of the disc 10 with the lowest pressure beneath the bottom surface 33, the peripheral edge of flap 40 moves away from lower end 36 allowing air to pass from the top of the disc to the bottom of the disc thereby equalising the pressure and assisting in prevention of stalling of the disc 10. As the rubber flap 40 is unable to pass in the upward direction beyond lower end 36 it also prevents the material being ground from passing through the aperture from below the bottom surface 33 to the top surface 35.

Figure 3:
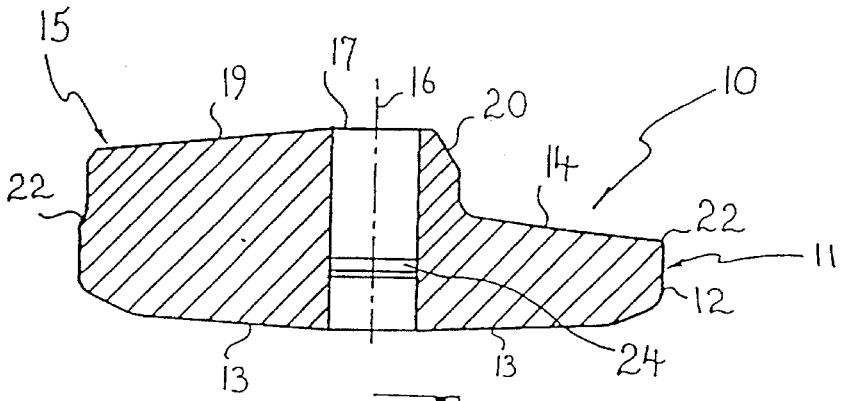
FIG. 3 is a sectional view of a pulverising disc of the second embodiment.

In the case of the second embodiment shown in FIG. 3, the pulverising disc has substantially the same form of that of the pulverising disc of FIGS. 1 and 2 with the exception that there is no radial recess or flute 23 provided on the under surface.

Figure 6:
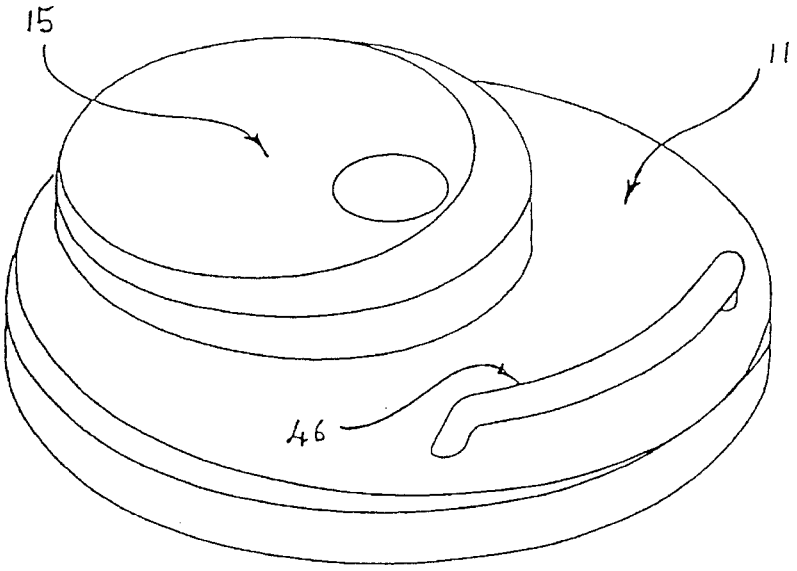
FIG. 6 is an isometric view of a third embodiment of the pulverising disc.

In FIG. 6 a third embodiment of the pulverising disc is shown which is in essence similar to the first two embodiments illustrated in FIGS. 1, 2 and 3. The only major difference between the third embodiment is the provision of a curved handle 46 on the upper surface 14. The handle 46 allows the disc 10 to be easily grabbed, lifted and moved from place to place either manually or by a small winch or hoist. This is of particular benefit in the handling of heavier pulverising discs, which can be of a mass up to and exceeding 19 kilograms. The handle can also assist in the mixing of the material within a pulverising bowl.

The operation of the pulverising disc of each of the embodiments will now be described with reference to FIGS. 4 and 5. The description is made in regard to a pulverising disc having the form of the second embodiment (ie without the radial recess or flute 23).

The pulverising disc as indicated previously is intended to co-act with a pulverising bowl 21 which is provided with a lid 25. The pulverising bowl 21 is substantially cylindrical having a side wall 26 and a bottom wall 27 which has an arcuate profile, particularly in the region most adjacent the side wall 26. In use, a quantity of rock material 30 which is to be ground, is located within the bowl 21. The pulverising disc is then located over the rock material within the bowl and the lid 25 is clamped into position. The bowl is then subjected to a shaking or oscillating action which causes the disc to move within the confines of the bowl and in so moving, it crushes the rock 30 and grinds it to a fine powder.

Figure 4:
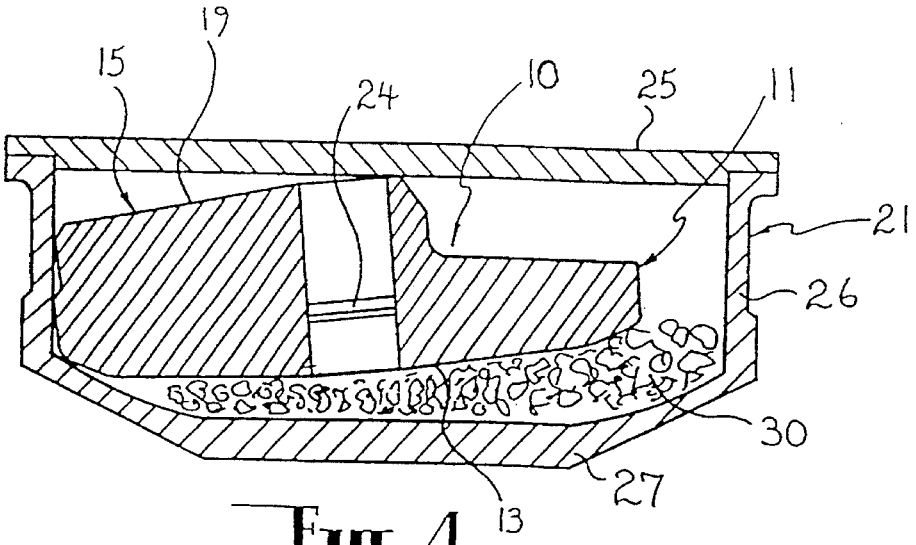
FIG. 4 illustrates the pulverising disc of the second embodiment in position within a pulverising bowl in the primary phase of the pulverising action.
Figure 5:
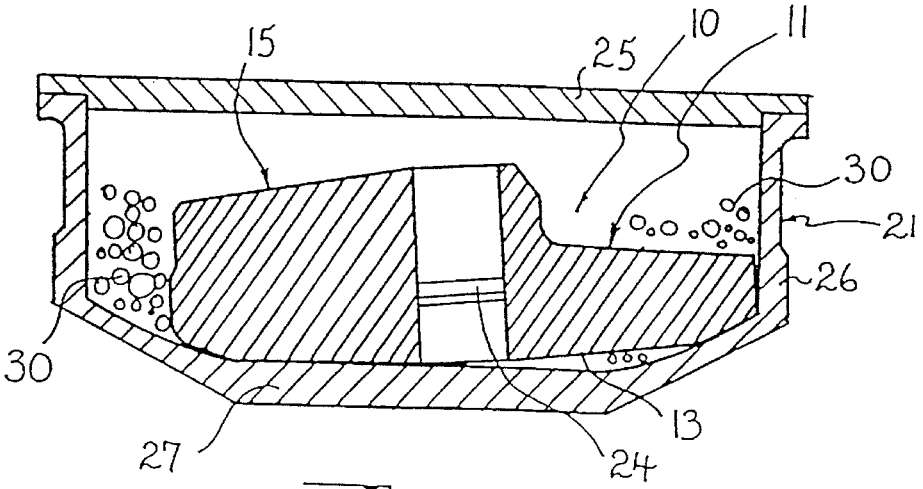
FIG. 5 illustrates the pulverising disc of the second embodiment in position within a pulverising bowl in the final phase of the grinding action.

Initially, during the primary grinding phase, the pulverising disc takes the position as shown at FIG. 4 where it lies on top of the rock material 30 and as a result central high region 18 is in abutment with an under surface of the lid 25. Because of the bevel on the upper surface 19 of the second body member 15, the pulverising disc is capable of pivotal motion transverse to the central axis 16 of the pulverising disc about an axis which intersects the region 18 on the upper surface comprising the upper perimeter of the aperture 17. This serves to limit the degree of wear contact between the pulverising disc and the lid 25 and also introduces a further degree of freedom of movement of the pulverising disc within the bowl 21 in the primary grinding phase.

As the pulverising action progresses, the pulverising disc will lower in its position within the pulveriser bowl 21 and will become disengaged from the lid 25.

During the pulverising action, it has been found that a low pressure region is created between the bottom surface 33 of the disc and the bottom wall 27 of the bowl. This then can create a difficulty as the rock material is ground to a fine powder in that this low pressure region can become sealed from the remainder of the environment and serve to hold the pulverising disc in position within the bowl or alternatively limit the degree of movement of the pulverising disc. In order to avoid this difficulty, the pulverising disc is provided with the aperture 17 which may also incorporate one way valve 24. The one way valve permits the free flow of air from above the top surface 35 of the pulverising disc which in turn serves to relieve any low pressure that may be created in that region and prevent the pulverising disc from becoming stuck to the bottom 27 of the bowl 21 or otherwise stalling. The one way valve when used serves to prevent the flow of any material upwardly through the aperture 17.

The presence of the second body 15 provides an eccentric mass which, when the disc 10 is in use, produces an eccentric inertial force to cause the disc 10 to not only move in accordance with the inertial forces created by the main body of the disc but also as a result of the inertial forces exerted upon the second body. Consequently the disc 10 also tends to orbit about axis 16 as it moves about bowl 21. The presence of the eccentric second mass also increases the inertial impact forces which can be exerted upon the material to be pulverised within the bowl. Furthermore, since the second body stands proud of the upper surface of the disc, it provides a means of mixing the contents of the bowl. The orbiting action of the disc 10 also provides a stirring action to the contents of the bowl which overlies the disc and serves to provide ample intermixing of the contents to prevent any segregation of the ground components.

This mixing action is further enhanced by the configuration of the edge of the pulverising disc most remote from the second body 15. As stated above, the edge of the main body 11 most remote from the second body 15 is formed with a thin chamfer 22 between the upper surface 14 and the circumferential wall 12. This configuration serves to enhance the penetration of that edge of the disc through the contents of the bowl during movement of the pulverising disc and cause the contents to ride over the upper surface of the pulverising disc. Such material is then caused to migrate over the upper end surface 14 of the main body until it is encountered by the second body 15 which then causes the material to be moved laterally.

In addition, the lower surface 13 of the main body 11 is formed with a contoured surface which differs in its profile from the profile of the bottom surface 27 of the bowl. This difference in profile ensures that as the disc moves over the surface of the bowl there is substantially no significant area of the undersurface of the disc which is in face to face engagement with a significant portion of the surface of the bowl and between which a low pressure region may be created to become sealed from the remainder of the contents of the bowl which can cause the pulverising disc to become stuck to the surface of the bowl or otherwise stall.

Now that embodiments of the invention have been described in detail it will be apparent to those skilled in the relevant arts that numerous modifications and variations may be made without departing from the basic inventive concepts. For example, the valve 24 can be made of any configuration which enables a unidirectional flow of air and prevents the flow of material in the opposite direction. In addition, the second body 15 can be made of a shape other than cylindrical. Further, while the second body 15 is shown as extending over the central axis 16 of the disc, it may be wholly located to one side of the central axis with the aperture 17 passing solely through the main body 11. In this case the highest region 18 on the second body is not, of course, located about the periphery of aperture 17. Moreover, the aperture 17 though shown as extending colinearly with axis 16 may be inclined to the axis 16. Also while the aperture 17 is shown as extending through second body 15 it may be disposed so as to pass through the main body 11 only. Finally, although the use of the disc 10 has been described in relation to the grinding of mineral samples it can be used to grind other materials including medicines or foodstuffs such as beans, nuts and herbs. All such modifications and variations are deemed to be within the scope of the present invention the nature of which is to be determined from the foregoing description and the appended claims.

I claim:

1. A pulverizing disc comprising:

a main body of generally cylindrical shape; and, a second body supported on an upper surface of said main body in a manner so that said first body and said second body are fixed relative to each other when said pulverizing disc moves, said second body being disposed eccentrically of said main body.

2. A pulverizing disc according to claim 1, wherein said pulverizing disc is provided with an aperture extending between a top surface and a bottom surface of said disc whereby, in use, air can flow from above said pulverizing disc through aperture to beneath said pulverizing disc.

3. A pulverizing disc according to claim 2, wherein the said second body extends across the upper surface of said main body from a position at one side of said main body to a position over a central axis of said disc, and said aperture extends through said second body.

4. A pulverizing disc according to claim 3, wherein said second body is formed integrally with said main body.

5. A pulverizing disc according to claim 3, wherein said second body is movably supported on said main body so that the degree of eccentricity can be varied in accordance with the nature of the material to be ground by the disc and the degree of pulverization required.

6. A pulverizing disc according to claim 3, wherein said aperture is formed about said central axis of the disc.

7. A pulverizing disc according to claim 6, wherein an upper surface of said second body is bevelled in the radial direction from the central axis of said disc to produce a central high region on the second body about the periphery of said aperture which is adapted to abut a lid of a pulverizer bowl in a pulverizing mill when said disc is in use.

8. A pulverizing disc according to claim 2, wherein said aperture is of divergent cross-section from one of said top and bottom surfaces of said disc to the other.

9. A pulverizing disc according to claim 2, wherein said aperture is of substantially constant cross-section throughout its length.

10. A pulverizing disc according to claim 2, wherein a one way valve is provided in said aperture to permit unidirectional flow of air from above the top surface to below the bottom surface of the disc.

11. A pulverizing disc according to claim 1, wherein a bottom surface of the disc is formed with a radial recess extending across at least a portion thereof to an edge of said disc.

12. A pulverizing disc according to claim 1, wherein the said second body extends across the upper surface of said main body from a position at one side of said main body to a position over a central axis of said disc.

13. A pulverizing disc according to claim 12, wherein a one way valve is provided in said aperture to permit unidirectional flow of air from above the top surface to below the bottom surface of the disc.

* * * * *